United States Patent [19]

Raynes et al.

[11] 4,364,493

[45] Dec. 21, 1982

[54] BEVERAGE DISPENSING SYSTEM

[75] Inventors: Stephen H. Raynes, Aylesbury; David H. Miller, Higher Denham, both of England

[73] Assignee: Arthur Guinness Son and Company (Park Royal) Limited, London, England

[21] Appl. No.: 125,909

[22] Filed: Feb. 29, 1980

Related U.S. Application Data

[63] Continuation-in-part of Ser. No. 66,611, Aug. 15, 1979, abandoned.

[51] Int. Cl.[3] ..... B65D 83/14

[52] U.S. Cl. ..... 222/399; 137/114; 251/61.2; 251/364

[58] Field of Search ..... 222/399, 394, 57; 137/114; 251/364, 61.2, 61.3, 61.4, 61.5, 122

[56] References Cited

U.S. PATENT DOCUMENTS 2,569,378 9/1951 Hood ..... 222/399 X 3,048,274 8/1962 Lundeen ..... 251/61.4 X

*Primary Examiner*—Allen N. Knowles

*Attorney, Agent, or Firm*—McCormick, Paulding & Huber

[57] ABSTRACT

A beverage dispensing system has a container from which beverage is to be dispensed by a gaseous mixture of air and carbon dioxide from passage 31. Air pressure for dispensing is derived from compressor 7. Carbon dioxide 11 is capable of communication with the container by way of a diaphragm valve 14 which normally closes communication between the carbon dioxide source 11 and the container. Diaphragm 16 of valve 14 is responsive to variations in pressure derived from compressor 7 so that the valve 14 opens communication between the carbon dioxide source 11 and the container when mixed gases are demanded. The diaphragm 16 controls displacement of a spool 19 which determines the opening and closing of communication between the carbon dioxide 11 and the container. A chamber 17 communicates with the air line 9 while a chamber 18 communicates with the container and is capable of communication with the carbon dioxide 11 under control of the spool 19. When air pressure develops on demand in line 9, restrictors 30 and 34 cause a pressure differential to develop across the displacement of the diaphragm 16 and of the spool 19 to admit carbon dioxide to the container together with the air.

25 Claims, 8 Drawing Figures

BEVERAGE DISPENSING SYSTEM

RELATED APPLICATIONS

This application is a continuation-in-part of application Ser. No. 066,611 filed Aug. 15, 1979 now abandoned.

This invention relates to a beverage dispensing system.

More particularly, the invention concerns the dispensing of a beverage from a bulk container such as a cask or a keg by the admission of gas under pressure to the container.

According to the present invention there is provided a beverage dispensing system comprising a container from which the beverage is to be dispensed by pressure of a gaseous mixture of carbon dioxide and a second gas comprising nitrogen; a source of said second gas which is to communicate under pressure and on demand with the container; a source of carbon dioxide under pressure which is capable of communication with the container by way of valve means and wherein said valve means is responsive to gaseous pressure in the system whereby upon the gaseous mixture being demanded for dispensing, pressure means by way the second gas under pressure is supplied on demand causes the valve means to be actuated to open communication between the source of carbon dioxide and the container and upon the demand for the gaseous mixture ceasing the valve means closes communication between the source of carbon dioxide and the container.

The invention was primarily developed for the dispensing of fermented liquor such as beer (by which is included lager, ale or stout) which will usually, but not invariably, be carbonated. By the system of the present invention the second gas can consist of nitrogen which is derived, for example, from a pressurised cylinder and supplied to the system by way of an appropriate reducing valve for the dispensing of, for example beer, from a cask. A mixture of carbon dioxide gas and a second gas which consists of, or is preferably primarily of, nitrogen is used to alleviate excessive carbonation of the beer (which can result by the use of carbon dioxide on its own at sufficient pressure to dispense the beer from the container). Consequently the nitrogen gas content can be regarded as being provided to dilute the carbon dioxide content although there are of course many well known advantages for dispensing beer under pressure with mixed gases of nitrogen and carbon dioxide, for example, to achieve a stable and aesthetically pleasing (creamy) head on the beer when dispensed. The supply of a gaseous nitrogen and carbon dioxide mixture is relatively expensive as compared with the supply of carbon dioxide on its own. It is preferred therefore that the second gas is air and the system of the present invention envisages the use of the nitrogen content of air as a dilutent for the carbon dioxide to avoid excessive carbonation in the beverage. A source of pressurised air is obtainable relatively inexpensively, for example from a compressor.

To alleviate the aforementioned excessive carbonation of the beverage in the container it is a feature of the invention that the source of carbon dioxide is maintained out of communication with the beverage until a flow of pressurised mixed gases is required; with this in mind the valve means is provided which normally closes communication between the source of carbon dioxide and the container but which valve means is responsive to a demand for the air or other second gas as a mixture with carbon dioxide for dispensing. This response may be caused by a variation in pressure on the valve means effected by the pressurised flow of, or by the direct or indirect effect of pressurising, the air or other second gas for dispensing which results in the valve means opening communication between the source of carbon dioxide and the container so that dispensing is effected by the pressurised mixture of carbon dioxide and the air (or other second gas comprising nitrogen) which is admitted to the container. When the demand for the mixed gases ceases there is again a variation in pressure on the valve means which results in such means again closing communication between the source of carbon dioxide and the container.

More particularly, the invention provides a beverage dispensing system comprising a bulk beer container from which the beverage is to be dispensed; a source of air under pressure from which pressurised air is available for admission to the container on demand for dispensing the beverage; a source of carbon dioxide under pressure from which pressurised carbon dioxide is capable of communication by way of valve means with the container for dispensing of the beverage as a gaseous mixture with said air under pressure; said valve means being responsive to variations in pressure in the system resulting from air pressurisation being effected for dispensing so that said valve means is actuated to open communication between the carbon dioxide source and the container by pressurised air being demanded and is actuated to close communication between the carbon dioxide source and the container by pressure variation which results in the system when the demand for air pressurisation ceases.

The valve means is desirably biased to a normally closed condition where the source of carbon dioxide is closed to communication with the container so that when the valve means is actuated in response to the demand for mixed gases under pressure for dispensing it is displaced against its biasing to open communication between the carbon dioxide source and the container. Preferably the valve means is pressure biased to its closed condition by the pressure of carbon dioxide from the carbon dioxide source which is arraged to be in constant communication with the valve means. The source of carbon dioxide will usually be a storage bottle from which the carbon dioxide supply is derived, directly or by way of a ring main, through a reducing valve.

In one form of the invention actuation of the valve means to effect supply of carbon dioxide to the container as a mixture with the second gas results from the development of pressure of the second gas in the system by the pressure means by which latter pressurised second gas is intended to be supplied, on demand, to the container. This development of pressure of the second gas by the pressure means (which will usually be a compressor) can serve to cause an increase in pressure on the valve means which actuates the valve means as aforementioned. For example, when the second gas is air, pressurised air which results on demand from an air compressor may communicate (downstream of the compressor) with the valve means which is actuated in response to a pressure differential effected on it by the compressed air to permit the flow of carbon dioxide under pressure which latter is then mixed, downstream of the valve means and of the air compressor, with the compressed air for dispensing. To achieve appropriate pressure differential on the valve means gas flow restrictors will usually be provided in the air line downstream of the compressor and of the valve means and in the carbon dioxide line downstream of the valve means—in each case the restrictors being located upstream of the junction between the air and carbon dioxide lines where the gases are mixed; with such an arrangement it is possible that if the system is operated in a humid atmosphere where there are no facilities or agents for drying the air, water drop-out will be experienced causing condensation downstream of the air compressor and upstream of the restrictor in the air line and this water drop-out may create a blockage in the air line restrictor to disrupt flow. To alleviate this latter possibility, it is therefore preferred that the aforementioned development of pressure of the second gas by the pressure means alternatively serves to cause a decrease in pressure on the valve means which actuates the valve means again as aforementioned. For example, pressure means in the form of a compressor can be located in the system downstream of the valve means to communicate with, and be common to both, carbon dioxide which emanates from the valve means and to the air or other second gas which are mixed prior to or on entering the compressor for pressurising and subsequent supply to the container for dispensing. With this latter arrangement operation of the compressor to induce air serves to provide a decrease in pressure on the valve means causing the latter to be actuated to open communication between the source of carbon dioxide and the compressor and thereby the container. Actuation of the valve means will be effected by the pressure differential to which such means is subjected by the decrease in pressure resulting from operation of the compressor and to achieve such a differential and also to control the proportions in which the gases are mixed, gas flow restrictors will usually be provided in the air line upstream of the compressor and also in the carbon dioxide line upstream of the compressor and downstream of the valve means. However, since the mixed gases are compressed (particularly the air) downstream of the restrictors any water drop-out which may occur as a result of such compression and as aforementioned will be without effect on the efficiency of the restrictors.

In a further form of the invention, actuation of the valve means to effect supply of carbon dioxide to the container results from the development of pressure of the second gas on demand by first pressure means which first pressure means is coupled to second pressure means, the latter being actuated in response to actuation of the first pressure means and actuation of the second pressure means causing the valve means to be actuated. Actuation of the second pressure means may cause a pressure differential to be applied to the valve means, preferably such actuation causing a decrease in pressure on the valve means, to open communication between the source of carbon dioxide and the container. In a further preferred embodiment the first pressure means is a first compressor through which air or other second gas is supplied by way of a first passage and the second pressure means is a second compressor which is located in a second passage downstream of the valve means from which it receives carbon dioxide. The first and second compressors are coupled for simultaneous operation to pressurise the air and carbon dioxide respectively which pressurised gases emerge from their respective compressors to be mixed prior to or on entering the container for dispensing. With this arrangement the first and second compressors may be separate but coupled together electrically or otherwise for simultaneous operation when there is demand for mixed gases or may have a common drive motor and be, for example, in the form of a double ended compressor. It will be apparent that on operation of the second compressor to induce carbon dioxide there will be a reduction in pressure on the valve means upstream thereof and this reduction serves to apply a pressure differential to the valve means causing the latter to be actuated. Since the air or other second gas and the carbon dioxide are independently pressurised for subsequent admixture by this form of the invention and the valve means is responsive to a pressure differential effected by operation of the compressor in the carbon dioxide line, gas flow restrictors can be omitted from the system so there is no possibility of the efficiency of such restrictors being impaired by water drop-out; futhermore a high flow rate of mixed gases can be achieved.

The valve means preferably has a displaceable valve member which is responsive to displacement of a diaphragm to open and close communication between the source of carbon dioxide and the container. This diaphragm is intended to be displaceable in response to the pressure differential which is developed across it in response to variations in gas pressure in the system which may be achieved as previously described. In the above described system in which the development of pressure of the second gas by the pressure means causes the valve means to be actuated it is preferred that the valve means has two chambers located on opposite sides of the diaphragm. A first of these chambers communicates with a first passage through which the air or other second gas is delivered on demand to the container and the second of the chambers communicates with a second passage through which carbon dioxide is to be delivered to the container. The displaceable valve member is responsive to displacement of the diaphragm to open and close communication between the source of carbon dioxide and the second chamber and is biased to a normally closed condition where it closes communication between the carbon dioxide source and the second chamber. In this arrangement a pressure differential develops across the diaphragm upon the second gas pressure developing in the system to meet a demand for that gas and this pressure differential effects in displacement of the diaphragm and adjustment of the valve member against its biasing to open communication between the source of carbon dioxide and the second chamber. In the above described systems where the development of pressure of the second gas in the system by the pressure means causes a decrease in pressure on the valve means or where there is provided the said first and second coupled pressure means actuation of the second pressure means of which causes the valve means to be actuated, the displaceable diaphragm of the valve means may partly define a chamber the pressure within which is decreased in response to development of pressure of the second gas by the first pressure means or in response to actuation of the second pressure means. This pressure decrease causes a pressure differential to develop across the diaphragm and displacement of the valve member to open communication between the source of carbon dioxide and the container. For so long as a sufficient pressure differential exists across the diaphragm, which differential may be achieved as aforementioned by subjecting one side of the diaphragm to second gas under pressure and the other side of the diaphragm to carbon dioxide under pressure or by subjecting one side of the diaphragm to atmospheric pressure and the other side of the diaphragm to carbon dioxide under pressure, a balanced or modulating position of the valve member can be attained whereby it is displaced from its normally closed condition to maintain the carbon dioxide supply to the container together with the air or other second gas supply. Upon a cease in the demand for mixed gases the pressure differential across the diaphragm decreases until the valve member is displaced to close communication between the carbon dioxide supply and the container. To ensure a rapid return of the valve member to its normally closed condition it is preferred that this member is biased into that condition by carbon dioxide under pressure derived from the source with which the valve member is in constant communication. For gas pressure biasing the valve member is conveniently in the form of a spool which is axially displaceable in a housing of the valve means and is coupled to the diaphragm for such displacement in response to displacement of the diaphragm. The spool has axially opposed faces with different effective areas of which the face with the larger effective area is in constant communication with the source of carbon dioxide whereby gas pressure reacting on said opposed faces provides a biasing force on the valve member to urge it to its normally closed condition when a demand for the mixed gases ceases.

When the second gas (usually air) and also the carbon dioxide as necessary, is pressurised by one or more compressors in the system, such compressors can be arranged to have a delivery commensurate with the rate at which beverage is drawn from the container and can be actuated in response to operation of a tap or other valve which is open to draw beverage from the container. Preferably however operation of the compressor (or admission into the system otherwise of a second gas such as nitrogen from a pressurised bottle) is controlled by a pressure switch which is responsive to the pressure of mixed gases in the head of the container so that when this pressure falls below a predetermined value (as will usually occur upon dispensing of the beverage) the compressor or compressors are actuated (or admission otherwise of the second gas is effected) automatically and cut out upon the predetermined mixed gas pressure being attained.

Where gas flow restrictors are incorporated in the system it will be apparent that such restrictors may be adjustable.

Several embodiments of beverage dispensing systems constructed in accordance with the present invention will now be described, by way of example only, with reference to the accompanying illustrative drawings, in which:

FIG. 1 is a diagrammatic illustration of a first system in which pressurisation of the gases is effected prior to them being mixed;

FIG. 2 diagrammatically shows a gas flow blending part of the system in FIG. 1 which part incorporates the valve means;

Figure 1:
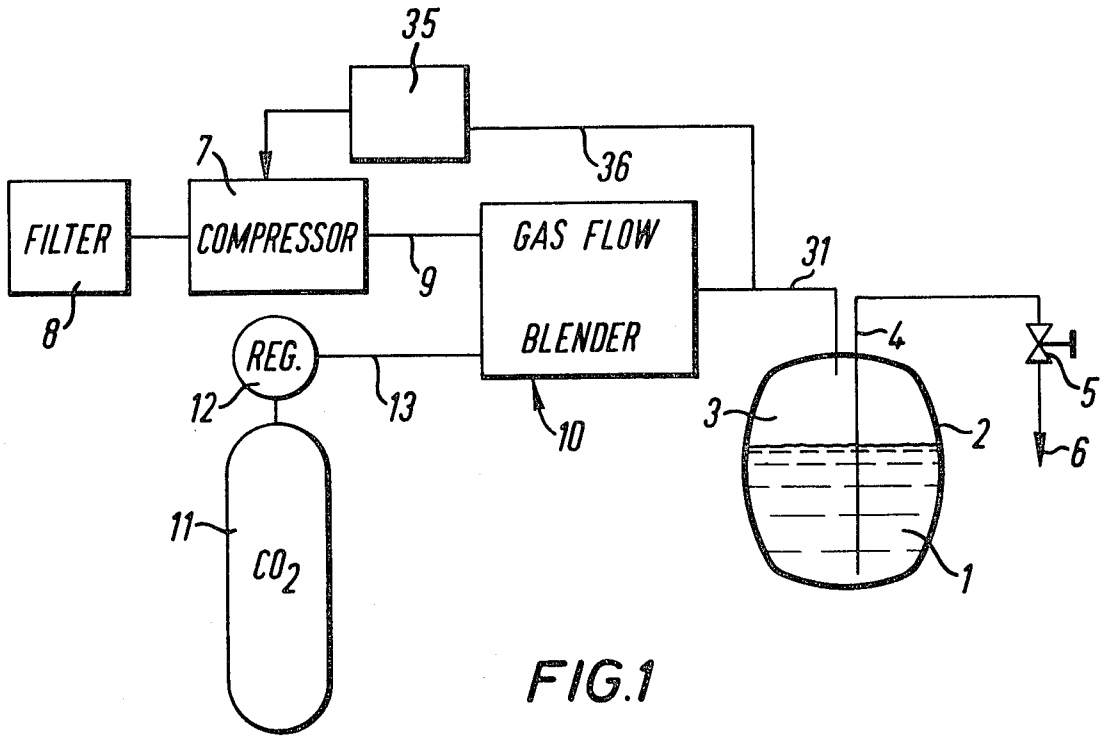

Each of the systems as shown in the Figures is intended for dispensing beer or stout 1 from a cask 2 whereby gas under pressure is supplied through passage 31 into the headspace 3 of the cask to dispense the beverage (by way of a riser tube 4 and a control tap 5) through a nozzle 6. The gas for pressurising the headspace 3 is formed by a mixture of gaseous carbon dioxide and air of which the air is drawn into the system through a bacterial filter 8 and the carbon dioxide supply is from a pressurised bottle 11 through a pressure regulator 12 and a carbon dioxide passage line 13.

Figure 2:
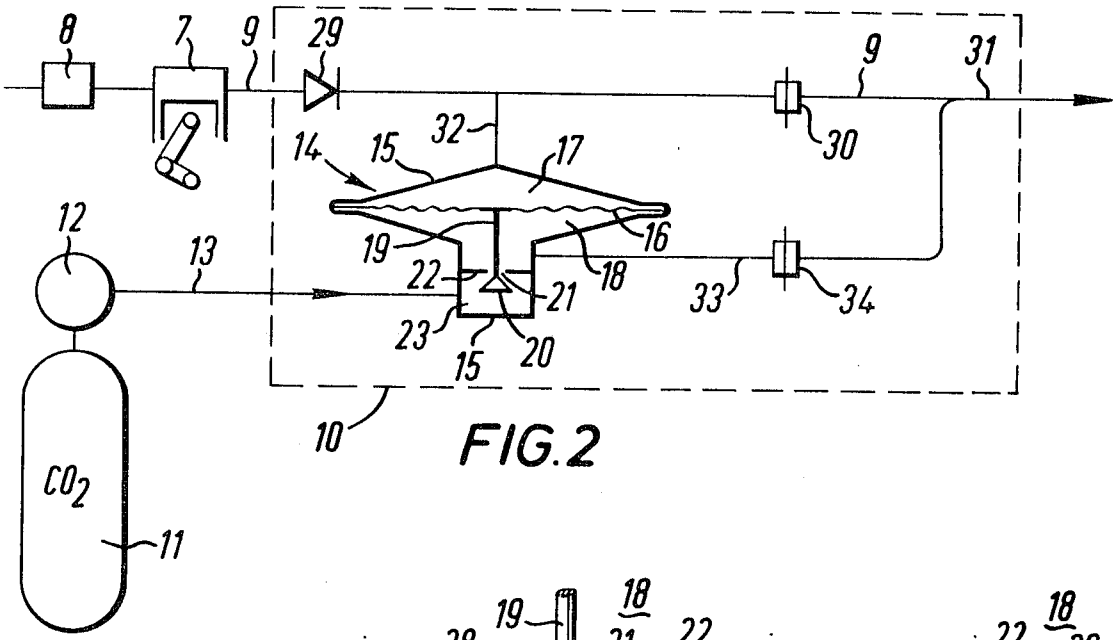

In the embodiment of FIGS. 1 to 3 the air is drawn through filter 8 and pressurised by a compressor 7 for supply through an air passage line 9 to a gas flow blending part 10 of the system. The carbon dioxide supply from the pressurised bottle 11 also passes by way of line 13 to the blender 10.

The gas flow blender 10 incorporates valve means shown generally at 14 (see FIG. 2) comprising a housing 15 within which is mounted a diaphragm 16. Formed on one side of the diaphragm and within the housing 15 is a first chamber 17 while a second chamber 18 is formed within the housing 15 on the opposite side of the diaphragm. Connected through the chamber 18 by a spool rod 19 to the diaphragm 16 is a spool 20 which is axially displaceable (in response to displacement of the diaphragm 16) within an aperture or bore 21 in a partition wall 22 of the housing 15. Formed between the partition wall 22 (on the side thereof remote from the chamber 18) and the housing 15 is a sub-chamber 23 which is in constant communication with the carbon dioxide supply by way of the passage 13.

Figure 3A:
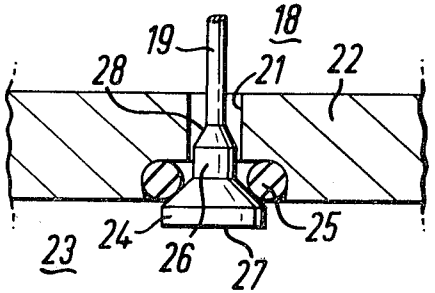
FIGS. 3A and 3B illustrate in part section operation of the valve means of FIG. 2.
Figure 3B:
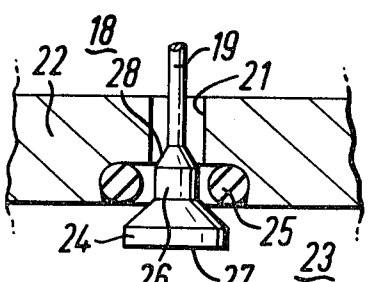

As shown in FIGS. 3A and 3B the spool 20 is capable, by its axial displacement, of opening and closing communication (by way of the aperture 21) between the chamber 18 and the sub-chamber 23. The spool 20 has a head 24 which projects into the sub-chamber 23 and this head, when the spool is in its closed condition, abuts an annular seal 25 mounted in a rebate in the partition wall 22. The spool 20 is stepped to taper progressively from the head 24 to its rod 19 so that in its closed condition a cylindrical body part 26 of the spool is a close sliding fit in the bore 21. By this tapered configuration the spool 20 provides a differential pressure operated type valve and has axially opposed faces 27 and 28 with different effective areas of which the face 27 on the head 24 and which opens to the sub-chamber 23 is of larger effective area than the face 28 which opens to the chamber 18.

The air line 9 from the compressor 7 communicates by way of a non-return valve 29 and a restrictor 30 with the pressure line 31 which opens into the headspace 3 of the cask. At a position downstream of the valve 29 and upstream of the restrictor 30 the air line 9 is in constant communication by way of a branch line 32 with the chamber 17. The chamber 18 of the valve means 14 is in constant communication by way of a carbon dioxide line 33 and a restrictor 34 with the pressure line 31 and thereby with the headspace 3.

Operation of the compressor 7 is controlled by a pressure switch 35 (FIG. 1) which is responsive by way of pressure line 36 to gas pressure in the line 31 and thereby in the headspace 3 so that when the pressure in the headspace falls below a predetermined value the pressure switch 35 is actuated automatically to operate the compressor 7 so that a required gaseous mixture of air and carbon dioxide is supplied on demand to the headspace 3 (in a manner which will be described hereinafter) until pressure in the cask attains the predetermined value which causes the compressor to be shut off.

In operation of the system and with the pressure in the headspace 3 at a predetermined value the spool 20 of the valve means is in its closed condition as shown in FIG. 3A. Upon a reduction in pressure in the headspace 3, as will occur when the tap 5 is opened to dispense beer from the cask, a sufficient reduction in pressure causes operation of the compressor 7 and the compressed air which is demanded flows by way of non return valve 29 through air line 9. A pressure drop is effected in the air line 9 by the restrictor 30 and consequently there is an air pressure increase upstream of the restrictor 30 and in the chamber 17. Upon initial flow of air through the line 9 pressure in the chamber 17 is greater than that in chamber 18. Since the force resulting from air pressure in chamber 17 on the large area of the diaphragm 16 is greater than the opposing force which will be developed by carbon dioxide pressure in the sub-chamber 23 on the smaller area end face 27 of the spool, the diaphragm flexes to displace the spool 20 axially downwardly in FIGS. 2 and 3B to open communication between the sub-chamber 23 and chamber 18. Consequently carbon dioxide flows by way of line 33 and restrictor 34 to mix with air from the line 9 in passage 31 prior to entering the headspace 3. Upon opening of the valve means as shown in FIG. 3B and the admission of carbon dioxide under pressure into the chamber 18 such pressure can increase due to the restrictor 34 until the pressure in chamber 18 is substantially the same as that in chamber 17 and the effect is to close the valve means to the condition shown in FIG. 3; however for so long as the compressor 7 is operating and air pressure develops in chamber 17 the practical effect is for the spool 24 to reach a balanced or modulating position relative to the bore 21 as shown in FIG. 3B where communication is maintained between the sub-chamber 23 and the chamber 18 so that the supply of carbon dioxide is maintained (together with the supply of air under pressure) shortly following operation of the compressor 7. By appropriate adjustment or selection of the restrictors 30 and 34 the ratio of flow rates as between the air and carbon dioxide can be proportioned as required (in a typical case it is envisaged that this latter proportion will be in the order of 40% carbon dioxide to 60% air).

When the gas pressure in the headspace 3 attains its predetermined value (which is likely to occur shortly following closure of the dispensing tap 5) and the demand for compressed air is satisfied the pressure switch 35 shuts off the compressor 7. The pressure in air line 9 downstream of the valve 29 consequently reduces and the pressures in chambers 17 and 18 of the valve means 14 become substantially equal. On this latter point it will be noted from FIG. 2 that both chambers 17 and 18 are in constant communication, by way of restrictors 33 and 34 respectively, with the headspace 3 and eventually the pressure in chambers 17 and 18 will be substantially equal to the pressure in the headspace. Consequently the diaphragm 16 will tend to revert to its normal, unstressed, condition and axially displace the spool 24 in a sense which progressively closes the bore 21. To ensure that communication between the sub-chamber 23 and chamber 18 by way of bore 21 closes rapidly the final displacement of the spool 20 into the bore 21 is assisted by the differential opposed face construction of the spool whereby the pressure of carbon dioxide in the sub-chamber 23 which reacts on the larger end face 27 provides a greater closing force on the spool than the force on the spool which results from the gas pressure in the chamber 18 reacting on the smaller end face 28; this latter force difference effected by the carbon dioxide pressure on the end face 27 also acts to firmly retain the spool in its closed condition (as shown in FIG. 3A where the spool head 24 abuts the seal 25).

If required spring or other resilient biasing means can be provided between the spool 20 and the housing 15 to bias the spool into its closed condition.

It is possible that when the system as above described with reference to FIGS. 1 to 3 is operated in a humid atmosphere (and in the absence of drying agents for the air) water drop-out will be experienced causing condensation downstream of the compressor 7, particularly in the passage 9 upstream of the restrictor 30. Such water drop-out may create a blockage in the restrictor 30 of the air line and this possibility can be alleviated by the system of FIGS. 4 and 5 in which the restrictors are relocated and compression of the gases is effected subsequent to them being mixed or by the system of FIGS. 6 and 7 which alleviates the requirement for any restrictors.

Figure 4:
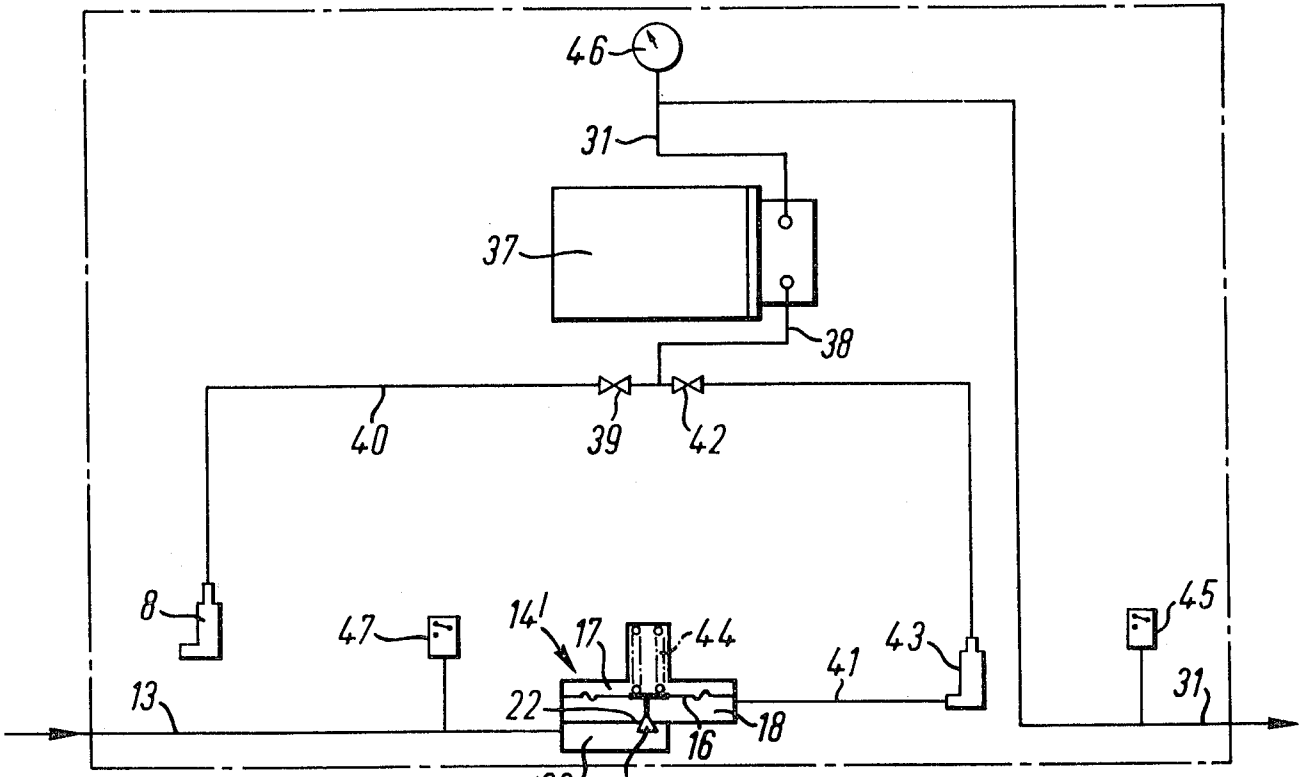
FIG. 4 is a diagrammatic illustration of a second system in which common pressurisation of the gases is effected subsequent to them being mixed.
Figure 5:
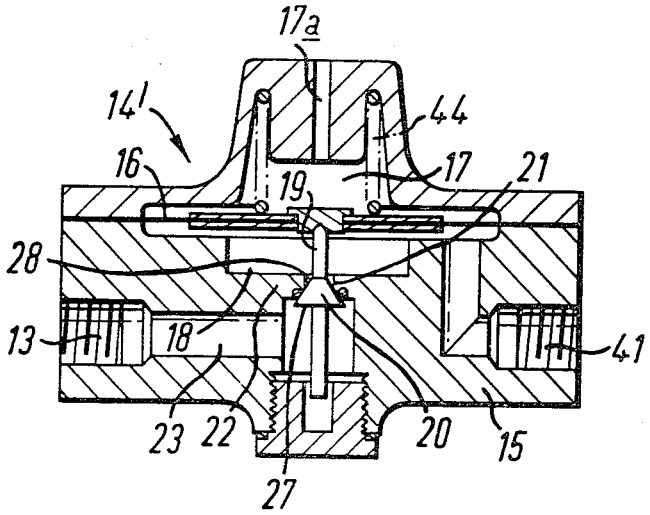
FIG. 5 illustrates, in section, valve means for controlling carbon dioxide flow in the system of FIG. 4.

In the embodiment of FIGS. 4 and 5 a compressor 37 is provided which draws in mixed gases for compression by way of a passage 38. One of these mixed gases is air which passes by way of filter 8 and restrictor 39 in passage 40 which communicates with the passage 38. The other gas of the mixture is carbon dioxide supplied by way of the line 13, valve means 14' and passage 41 which communicates by way of a restrictor 42 with the passage 38. If required, a filter 43 for the carbon dioxide can be incorporated in the passage 42. Pressurised mixed gases emanating from the compressor 37 communicate through the line 31 with the headspace 3 of the cask 2.

The valve means 14' is in many respects similar to the valve means 14 of FIG. 2 and comprises the housing 15 within which is mounted the diaphragm 16. Formed on one side of the diaphragm and within the housing 15 is the chamber 17 which is open to atmospheric pressure by way of a passage **17*a*. The second chamber 18 is formed within the housing 15 on the opposite side of the diaphragm 16 and connected through the chamber 18 by the spool rod 19 to the diaphragm 16 is the spool 20 which is axially displaceable (in response to displacement of the diaphragm) within an aperture 21 in the partition wall 22 of the housing 15. The partition wall 22 partly defines the sub-chamber 23 on the side thereof remote from the chamber 18 and this sub-chamber 23 is in constant communication with the carbon dioxide supply line 13. The spool 20 of the valve means 14' is capable, by its axial displacement, of opening and closing communication by way of the aperture 21 between the sub-chamber 23 and the chamber 18 and is similarly tapered to the spool as shown in FIGS. 3A and 3B for gas pressure differential biasing. A compression spring 44 is provided in the chamber 17 to react between the housing 15 and the diaphragm 16 to urge the diaphragm for displacement in a direction which displaces the spool 20 to open the aperture 21**.

The chamber 18 is in constant communication with the passage 41 and thereby through the restrictor 42 with the compressor 37.

Located in the line 31 is a pressure switch 45 which controls actuation of the compressor 37 so that when the pressure of mixed gases in the headspace 3 falls below a predetermined pressure as required for dispensing purposes the switch 45 automatically starts operation of the compressor 37 and also switches off the compressor when the required pressure of mixed gases in the headspace is attained.

When the compressor 37 of FIGS. 4 and 5 is actuated by the pressure switch 45 air is drawn into the compressor through passage 40, restrictor 39 and passage 38. In addition the operation of the compressor 37 causes a reduction of pressure in the chamber 18 of valve 14' through passage 38, restrictor 42 and passage 41. Such a reduction in pressure in the chamber 18 causes the diaphragm 16, assisted by the spring 44, to be displaced downwardly in FIG. 5 to open the aperture 22 from the spool 20 and thereby open communication between carbon dioxide in the line 13 to the chamber 18 and consequently with the compressor 37. Air and carbon dioxide in mixture are therefore supplied to the compressor 37 for pressurisation and subsequent supply by way of passage 31 to the headspace for dispensing purposes. As soon as the pressure of the mixed gases in the headspace 3 attains that required for dispensing the compressor 37 is shut off by the pressure switch 45, the pressure in the line 41 and thereby in the chamber 18 reduces towards atmospheric pressure and pressure of carbon dioxide in the chamber 23 reacting on the head of the spool 20 effects in rapid displacement of the spool to close the aperture 21 by gas pressure differential as described with reference to FIGS. 3A and 3B.

The proportions in which the air and carbon dioxide are supplied for mixture along the passage 38 and in the compressor 37 can be controlled in part by appropriate selection of the restrictors 39 and 42. Furthermore, the opening and closing of the aperture 22 by the valve 20 can be controlled by appropriate selection of the spring 44.

In the embodiment of FIGS. 4 and 5 it will be apparent that compression of the air is effected downstream of the restrictor 39 and consequently if there is any water drop-out as a result of air compression it will be without effect either on the restrictor 39 or the restrictor 42. Since the compressor 37 also serves to pressurise the carbon dioxide as a mixture with the air it is preferred that the carbon dioxide is supplied to the valve means 14' at a pressure greater than atmospheric which is subsequently reduced in passing through the valve 14' to approximately atmospheric or sub-atmospheric pressure in the line 41 (when the compressor is operating). In a preferred arrangement the regulator valve 12 of the carbon dioxide supply is arranged for the carbon dioxide in line 13 to be at approximately 34 pounds per square inch (absolute).

A pressure gauge 46 is provided in the passage 31 for convenience of inspecting the pressure of mixed gases which is available for dispensing. A pressure switch 47 can be provided as an optional feature in the carbon dioxide passage line 13 which is arranged to stop the compressor 37 in the event that the pressure of carbon dioxide in the line 13 falls below a predetermined minimum, for example should the carbon dioxide cylinder 11 empty.

Figure 7:
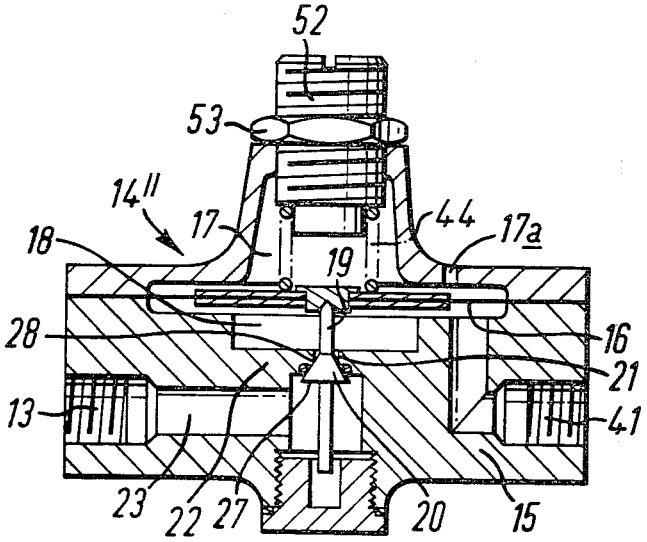
FIG. 7 illustrates, in section, valve means for controlling carbon dioxide flow in the system of FIG. 6.
Figure 6:
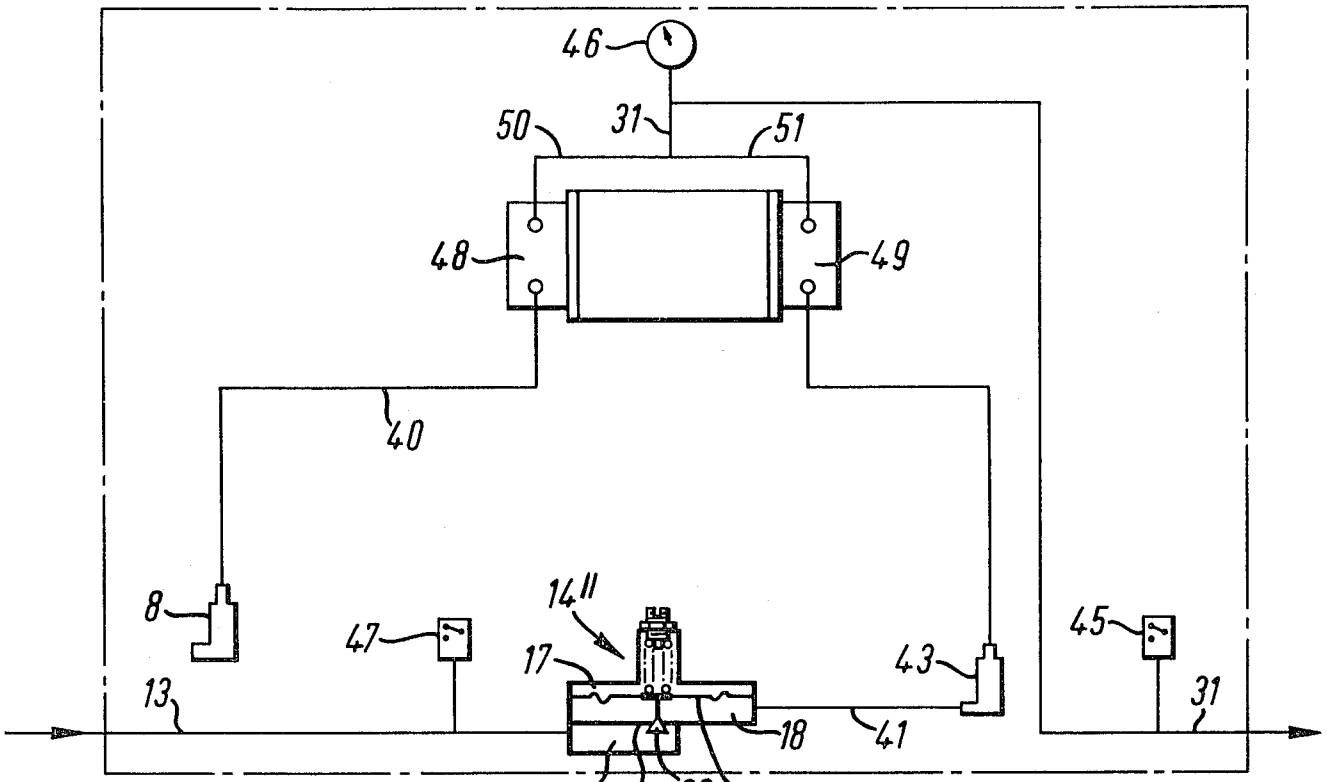
FIG. 6 is a diagrammatic illustration of a third system in which independent pressurisation of the gases is effected subsequent to them being mixed.

The system in the embodiment of FIGS. 6 and 7 is similar in many respects to that shown in the embodiment of FIGS. 4 and 5 with two main exceptions in that two compressors 48 and 49 are provided and the restrictors have been omitted. The compressors 48 and 49 are coupled together for simultaneous operation under control of the pressure switch 45 and conveniently these compressors are driven by a common motor (in the manner of a double ended compressor); for practical purposes the characteristics and performances of the compressors may be identical. As shown in FIG. 6 the compressor 48 communicates directly through passage 40 and filter 8 with air while compressor 49 is intended to communicate with the carbon dioxide line 13 by way of filter 43, passage 41 and valve means 14". The valve means 14" operates in response to a pressure reduction effected by actuation of the compressor 49 in a similar manner to the valve means 14' of the embodiment of FIG. 4 to open communication between carbon dioxide in the line 13 and the compressor 49.

On operation of the coupled compressors 48 and 49 by the pressure switch 45 in demand for pressurised mixed gases for dispensing, air is drawn into the compressor 48 by way of filter 8 and passage 40 whilst carbon dioxide is simultaneously drawn into the compressor 49 through valve means 14", passage 41 and filter 43. The pressurised air emerging from the compressor 48 communicates by way of passage 50 with the line 31 while the pressurised carbon dioxide from the compressor 49 also communicates with the line 31 through passage 51 and consequently it is not until after compression of the respective gases and until in the line 31 for passage to the headspace 3 that the gases are mixed.

As previously mentioned the valve means 14" (see FIG. 7) is similar in all major respects to the valve means 14' as shown in FIG. 5. However the valve 14" incorporates means for varying the biasing effect of spring 44 and as shown in FIG. 7 this means comprises a screw 52 in the housing 15 and against which screw the spring 44 reacts so that by adjustment of the screw the force exerted by the spring on the diaphragm 16 is adjustable. A lock nut 53 is provided on the screw 52 to secure it in an appropriately adjusted position.

The omission of restrictors from the embodiments of FIGS. 6 and 7 again alleviates the likelihood of the required supply of mixed gases being disrupted by water drop-out due to the compression of air; furthermore it permits higher flow rates of mixed gases than that which can be achieved when using restrictors in the respective air and carbon dioxide lines. Since the restrictors have been omitted from the embodiment of FIG. 6 the relative proportions in which the gases are mixed can be controlled wholly by the valve means 14" by appropriate adjustment of the screw 52 and thereby compression in the spring 44 to give the required characteristics for opening of the valve means 14" to admit carbon dioxide into the system for mixing when the compressors 48 and 49 are actuated; for example, as the compressive force in spring 44 is increased by adjustment of the screw 52 then the greater is the proportion of carbon dioxide which will be admitted for pressurisation and subsequent admixture with the air.

Usually non-return valves will be provided in the air and carbon dioxide lines to the compressor or compressors in FIGS. 4 and 6 but these have been omitted from the drawings for convenience.

We claim:

1. A beverage dispensing system comprising a container from which the beverage is to be dispensed by pressure of a gaseous mixture of carbon dioxide and a second gas comprising nitrogen; a source of said second gas which is to communicate under pressure and on demand with the container; a source of carbon dioxide under pressure which is capable of communication with the container by way of valve means, said valve means being responsive to gaseous pressure in the system whereby upon the gaseous mixture being demanded for dispensing, pressure means by which the second gas under pressure is supplied on demand causes the valve means to be actuated to open communication between the source of carbon dioxide and the container and upon the demand for the gaseous mixture ceasing the valve means closes communication between the source of carbon dioxide and the container, and wherein the development of pressure of said second gas in the system by said pressure means causes the valve means to be actuated.

2. A system as claimed in claim 1 in which the second gas is air.

3. A system as claimed in claim 1 in which the valve means is biased to a normally closed condition where the source of carbon dioxide is closed to communication with the container so that when said valve means is actuated in response to the demand for the gaseous mixture the valve means is displaced against its biasing to open communication between the carbon dioxide source and the container.

4. A system as claimed in claim 3 in which the carbon dioxide source is in constant communication with the valve means and said valve means is pressure biased to its closed condition by pressure of carbon dioxide from said carbon dioxide source.

5. A system as claimed in claim 1 in which the development of pressure of said second gas in the system by said pressure means causes an increase in pressure on the valve means which actuates the valve means to open communication between the source of carbon dioxide and the container.

6. A system as claimed in claim 1 in which the development of pressure of said second gas in the system by said pressure means causes a decrease in pressure on the valve means which actuates the valve means to open communication between the source of carbon dioxide and the container.

7. A system as claimed in claim 6 in which the pressure means is located in the system downstream of the valve means and wherein carbon dioxide emanating from the valve means and said second gas are mixed to provide said gaseous mixture for pressurising by said pressure means which is common to both said gases.

8. A system as claimed in claim 1 in which admission into the system of said second gas by said pressure means is controlled by pressure switch means which is responsive to mixed gas pressure in the container whereby when said mixed gas pressure falls below a predetermined value admission of said second gas and thereby carbon dioxide is effected automatically and when said mixed gas pressure attains a predetermined value said admission ceases automatically.

9. A system as claimed in claim 1 in which said pressure means comprises at least one compressor.

10. A beverage dispensing system comprising a container from which the beverage is to be dispensed by pressure of a gaseous mixture of carbon dioxide and a second gas comprising nitrogen; a source of said second gas which is to accommodate under pressure and on demand with the container; a source of carbon dioxide under pressure which is capable of communication with the container by way of valve means, said valve means being responsive to gaseous pressure in the system whereby upon the gaseous mixture being demanded for dispensing, pressure means by which the second gas under pressure is supplied on demand causes the valve means to be actuated to open communication between the source of carbon dioxide and the container and upon the demand for the gaseous mixture ceasing the valve means closes communication between the source of carbon dioxide and the container, and wherein the development of pressure of said second gas in the system on demand is by first said pressure means which first pressure means is coupled to second said pressure means, said second pressure means being actuated in response to actuation of the first pressure means and actuation of the second pressure means causing the valve means to be actuated.

11. A system as claimed in claim 10 in which actuation of the second pressure means causes a decrease in pressure on the valve means to open communication between the source of carbon dioxide and the container.

12. A system as claimed in claim 11 in which the first pressure means comprises a first compressor and the second pressure means comprises a second compressor coupled to the first compressor for simultaneous operation therewith, and wherein the first compressor is located in first passage means through which the second gas is supplied and the second compressor is located in second passage means downstream of the valve means from which it receives carbon dioxide, the compressed second gas and carbon dioxide gas emanating from the respective compressors being mixed for supply on demand to the container for dispensing.

13. A system as claimed in claim 10 in which the second gas is air.

14. A system as claimed in claim 10 in which the valve means is biased to a normally closed condition where the source of carbon dioxide is closed to communication with the container so that when said valve means is actuated in response to the demand for the gaseous mixture the valve means is displaced against its biasing to open communication between the carbon dioxide source and the container.

15. A system as claimed in claim 14 in which the carbon dioxide source is in constant communication with the valve means and said valve means is pressure biased to its closed condition by pressure of carbon dioxide from said carbon dioxide source.

16. A beverage dispensing system comprising a container from which the beverage is to be dispensed by pressure of a gaseous mixture of carbon dioxide and a second gas comprising nitrogen; a source of said second gas which is to communicate under pressure and on demand with the container; a source of carbon dioxide under pressure which is capable of communication with the container by way of valve means, said valve means being responsive to gaseous pressure in the system whereby upon the gaseous mixture being demanded for dispensing, pressure means by which the second gas under pressure is supplied on demand causes the valve means to be actuated to open communication between the source of carbon dioxide and the container and upon the demand for the gaseous mixture ceasing the valve means closes communication between the source of carbon dioxide and the container; said valve means comprising a displaceable valve member which is responsive to displacement of a diaphragm to open and close communication between the source of carbon dioxide and the container, said diaphragm being displaceable in response to a pressure differential which is developed across it in response to variations in gas pressure in the system, the development of pressure of said second gas in the system by said pressure means causing an increase in pressure on the valve means which actuates the valve means to open communication between the source of carbon dioxide and the container; and wherein said valve means comprises two chambers located on opposite sides of the displaceable diaphragm, a first of said chambers communicating with first passage means through which said second gas is delivered on demand to the container and the second of said chambers communicating with second passage means through which carbon dioxide is to be delivered to the container; the displaceable valve member being responsive to displacement of the diaphragm to open and close communication between the source of carbon dioxide and the second chamber and being biased to a normally closed condition where it closes communication between the carbon dioxide source and the second chamber, and wherein a pressure differential develops across the diaphragm upon said second gas pressure developing in the system to meet a demand for said second gas which pressure differential effects in displacement of the diaphragm and adjustment of said valve member against its biasing to open communication between the source of carbon dioxide and the second chamber.

17. A system as claimed in claim 16 in which restrictor means are located in said first and second passage means respectively downstream of said first and second chambers for developing a pressure differential across the diaphragm.

18. A system as claimed in claim 16 in which the valve member is in constant communication with the carbon dioxide source and is biased to its closed condition by pressure of carbon dioxide from said source.

19. A system as claimed in claim 18 in which the valve member comprises a spool which is axially displaceable in a housing of the valve means and is coupled to the diaphragm for such displacement in response to displacement of the diaphragm; said spool having axially opposed faces with different effective areas of which the face with the larger effective area is in constant communication with the source of carbon dioxide whereby gas pressure reacting on said opposed faces provides a biasing force on the valve member to urge it to its normally closed condition when a demand for the mixed gases ceases.

20. A system as claimed in claim 16 in which the second gas is air.

21. A system as claimed in claim 16 in which the valve means is biased to a normally closed condition where the source of carbon dioxide is closed to communication with the container so that when said valve means is actuated in response to the demand for the gaseous mixture the valve means is displaced against its biasing to open communication between the carbon dioxide source and the container.

22. A system as claimed in claim 21 in which the carbon dioxide source is in constant communication with the valve means and said valve means is pressure biased to its closed condition by pressure of carbon dioxide from said carbon dioxide source.

23. A beverage dispensing system comprising a container from which the beverage is to be dispensed by pressure of a gaseous mixture of carbon dioxide and a second gas comprising nitrogen; a source of said second gas which is to communicate under pressure and on demand with the container; a source of carbon dioxide under pressure which is capable of communication with the container by way of valve means, said valve means being responsive to gaseous pressure in the system whereby upon the gaseous mixture being demanded for dispensing, pressure means by which the second gas under pressure is supplied on demand causes the valve means to be actuated to open communication between the source of carbon dioxide and the container and upon the demand for the gaseous mixture ceasing the valve means closes communication between the source of carbon dioxide and the container; said valve means comprising a displaceable valve member which is responsive to displacement of a diaphragm to open and close communication between the source of carbon dioxide and the container, said diaphragm being displaceable in response to a pressure differential which is developed across it in response to variations in gas pressure in the system, the development of pressure of said second gas in the system by said pressure means causing a decrease in pressure on the valve means which actuates the valve means to open communication between the source of carbon dioxide and the container and wherein the displaceable diaphragm partly defines a chamber gaseous pressure within which is decreased in response to the development of pressure of said second gas by said pressure means, said pressure decrease causing a pressure differential to develop across the diaphragm and displacement of the valve member to open communication between the source of carbon dioxide and the container.

24. A system as claimed in claim 23 in which the pressure means is located in the system downstream of the valve means and carbon dioxide emanating from the valve means and said second gas are mixed to provide said gaseous mixture for pressurising by said pressure means which is common to both said gases and wherein, prior to their mixing, the second gas passes through first restrictor means and the carbon dioxide passes through second restrictor means located downstream of the valve means.

25. A beverage dispensing system comprising a container from which the beverage is to be dispensed by pressure of a gaseous mixture of carbon dioxide and a second gas comprising nitrogen; a source of said second gas which is to communicate under pressure and on demand with the container; a source of carbon dioxide under pressure which is capable of communication with the container by way of valve means, said valve means being responsive to gaseous pressure in the system whereby upon the gaseous mixture being demanded for dispensing, pressure means by which the second gas under pressure is supplied on demand causes the valve means to be actuated to open communication between the source of carbon dioxide and the container and upon the demand for the gaseous mixture ceasing the valve means closes communication between the source of carbon dioxide and the container; said valve means comprising a displaceable valve member which is responsive to displacement of a diaphragm to open and close communication between the source of carbon dioxide and the container, said diaphragm being displaceable in response to a pressure differential which is developed across it in response to variations in gas pressure in the system, the development of pressure of said second gas in the system and demand being by first said pressure means which first pressure means is coupled to second said pressure means, said second pressure means being actuated in response to actuation of the first pressure means and actuation of the second pressure means causing the valve means to be actuated, and wherein the displaceable diaphragm partly defines a chamber gaseous pressure within which is decreased in response to actuation of said second pressure means, said pressure decrease causing a pressure differential to develop across the diaphragm and displacement of the valve member to open communication between the source of carbon dioxide and the container.

* * * * *